US011642907B2

(12) United States Patent
Chess

(10) Patent No.: US 11,642,907 B2
(45) Date of Patent: May 9, 2023

(54) SECURE PLACARD AND METHOD FOR PRODUCING SAME

(71) Applicant: R. R. DONNELLEY & SONS COMPANY, Chicago, IL (US)

(72) Inventor: Stanley C. Chess, Goffstown, NH (US)

(73) Assignee: R. R. DONNELLEY & SONS COMPANY, Chicago, IL (US)

( * ) Notice: Subject to any disclaimer, the term of this patent is extended or adjusted under 35 U.S.C. 154(b) by 0 days.

(21) Appl. No.: 17/198,980

(22) Filed: Mar. 11, 2021

(65) Prior Publication Data

US 2021/0283940 A1 Sep. 16, 2021

Related U.S. Application Data

(60) Provisional application No. 62/988,234, filed on Mar. 11, 2020.

(51) Int. Cl.

| | |
|---|---|
| ***B42D 25/328*** | (2014.01) |
| ***G09F 3/04*** | (2006.01) |
| ***G09F 3/02*** | (2006.01) |

(52) U.S. Cl.

CPC ..... *B42D 25/328* (2014.10); *G09F 3/02* (2013.01); *G09F 3/04* (2013.01); *G09F 2003/0202* (2013.01)

(58) Field of Classification Search

CPC . B42D 25/328; G09F 3/02; G09F 3/04; G09F 2003/0202

See application file for complete search history.

(56) References Cited

U.S. PATENT DOCUMENTS

| | | | | |
|---|---|---|---|---|
| 2008/0018098 | A1* | 1/2008 | Crum | B42D 15/02 283/114 |
| 2011/0259775 | A1* | 10/2011 | Bratter | G09F 3/0288 156/247 |
| 2013/0161938 | A1* | 6/2013 | Mayrhofer | B42D 15/00 283/81 |
| 2017/0249876 | A1* | 8/2017 | Emoff | G09F 23/0083 |

OTHER PUBLICATIONS

SecuraPass Holographic Parking Permits (https://www.myparkingpermit.com/Parking-Permits/Holographic-Parking-Pass; pp. 1-4, via Internet Wayback Machine Feb. 26, 2019 https://web.archive.org/web/20190226035021/https:/www.myparkingpermit.com/Parking-Permits/Holographic-Parking-Pass pp. 5-7 (Year: 2019).*

* cited by examiner

*Primary Examiner* — Laura C Powers

(74) *Attorney, Agent, or Firm* — McCracken & Gillen LLC

(57) ABSTRACT

A secure placard and a method of producing the secure placard are disclosed. A substrate includes a first portion and a second portion. The first portion of a substrate has varnish applied thereto and a holographic pattern is formed in the varnish. The substrate also includes a second portion that is free of the varnish. The second portion of the substrate is adapted to be printed on using a heat-based process without damage to the holographic pattern.

18 Claims, 3 Drawing Sheets

SECURE PLACARD AND METHOD FOR PRODUCING SAME

CROSS-REFERENCE TO RELATED APPLICATIONS

The present application claims benefit of Chess, U.S. Provisional Application Ser. No. 62/988,234, filed on Mar. 11, 2020, and entitled "Secure Parking Permit and Method for Making Same." The entire contents of this application are incorporated herein by reference.

FIELD OF DISCLOSURE

The present subject matter relates to a secure printed permit placard and a method for producing a secure printed permit placard, and more particularly, to a secure printed permit placard having a holographic pattern disposed thereon and a method of making same.

BACKGROUND

A disabled person operating or riding in a vehicle that displays parking permit in the form of a placard may be permitted to park such vehicle in a location reserved for disabled persons. The permit may include imprinted and/or written information that includes an identifier (e.g., a sequence of characters and numerals), an expiration date, an issuing authority, and the like.

A security device, such as a holographic film, may be applied to the parking permit to allow one to confirm the authenticity thereof. Further, because such holographic film cannot be easily duplicated using, for example, xerography, the holographic film prevents manufacture of counterfeit permits.

However, after a holographic film is applied to a substrate, such substrate may be difficult to print upon using, for example, a toner-based printing device, such as a laser printer, that requires heat for fusing. For example, the holographic film applied to the substrate may accumulate static electricity as the substrate is transported through the printing device and may cause misfeeds. Further, the temperatures required to fuse toner to the substrate may damage (e.g., melt) the holographic film. Still further, the thickness of the holographic film may cause stacking issues associated with the substrate and jamming of the substrate as it passes through a laser printer device.

Aspects and advantages of the embodiments disclosed herein will become apparent upon consideration of the following detailed description and the attached drawings wherein like numerals designate like structures throughout the specification.

SUMMARY

According to one aspect, a secure placard includes a printable layer that comprises a first portion and a second portion. A radiation cured layer of varnish is disposed on the first portion of the printable layer and the layer of varnish has a holographic pattern formed therein prior to curing. The second portion of the printable layer is free of the varnish. The printable layer is adapted to be transportable through a printing device to receive printing on the second portion using a heat-based process without damage to the holographic pattern after the layer of varnish is disposed on the first portion.

According to another aspect, a method of producing a secure placard comprising a printable layer having a first portion and a second portion includes the steps of applying varnish onto the first portion of the printable layer, forming a holographic pattern in the varnish in the first portion, and curing the varnish layer in the first portion using radiation. The printable layer is adapted to be transportable through a printing device to receive printing on the second portion using a heat-based process after the varnish is applied on the first portion and without damaging the holographic pattern, wherein the second portion of the printable layer is free of the varnish.

BRIEF DESCRIPTION OF THE DRAWINGS

FIG. 1B is formed;

DETAILED DESCRIPTION

Figure 1A:
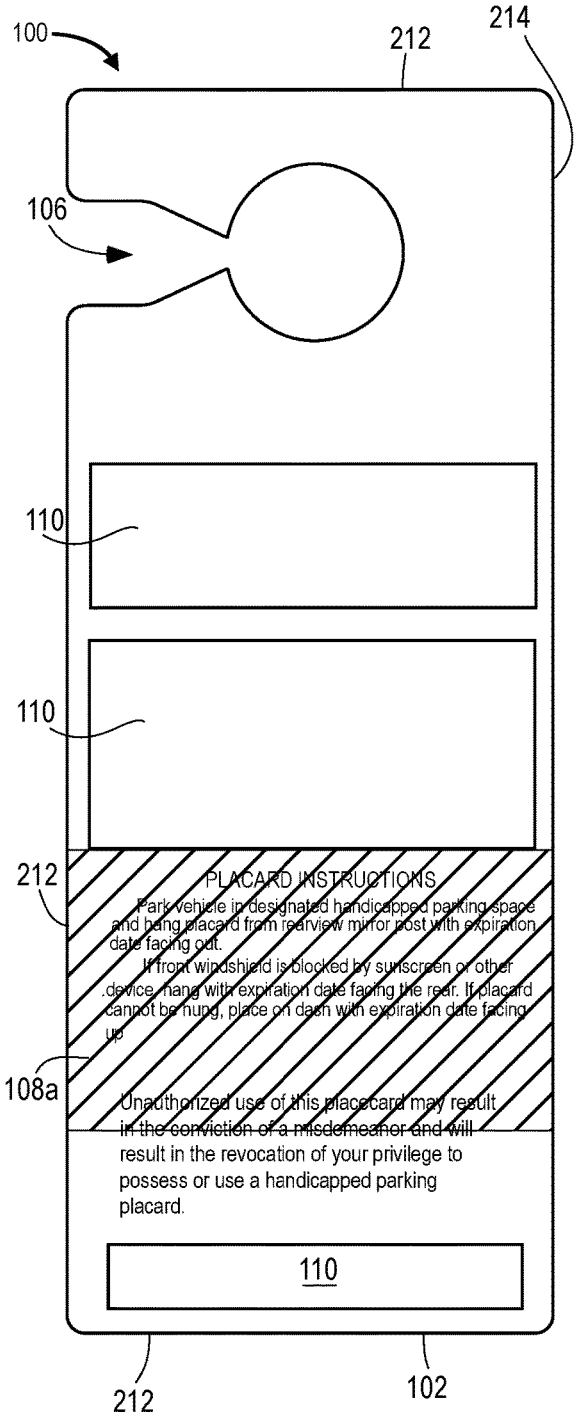
FIG. 1A is an elevational view of a front side of a secure placard.
Figure 1B:
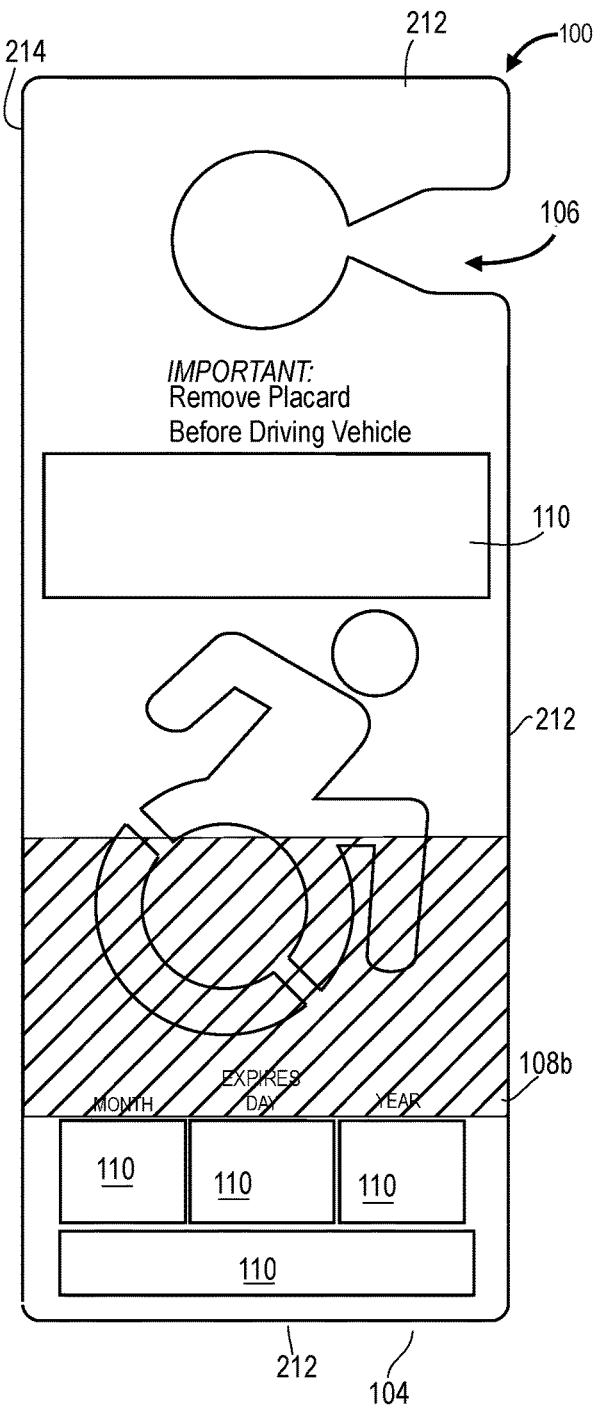
FIG. 1B is an elevational view of a rear side of a secure placard.

Referring to FIGS. 1A and 1B, a secure placard 100, for example, a parking permit placard, includes a first side 102 and a second side 104. Each of the first side 102 and second side 104 includes a cut-out section 106 that facilitates hanging the secure placard from, for example, a rear-view mirror of a vehicle. In addition, the secure placard 100 includes a holographic portion 108*a* and 108*b* on the front side 102 and/or rear side 104, respectively. The holographic portions 108 include a pre-determined pattern embedded therein that make such holographic portions difficult to duplicate using conventional xerography or other duplication means. Further, refraction of light through such holographical portions 108 varies in accordance with the predetermined pattern as the secure placard 100 is viewed from different angles. Thus, the authenticity of the holographic portion 108 (and, therefore, of the secure placard 100) can be visually confirmed.

The secure placard 100 also includes one or more regions 110 in which additional information may be imprinted. In a preferred embodiment, such additional information is imprinted using xerography (e.g., using a laser printer) or another heat-based printing process. Such additional information may include the name of the person to whom the secure placard 100 is issued, a license plate number of the vehicle with which the secure placard 100 may be used, information regarding an authority that issued the secure placard 100, a month, day, and year when the secure placard 100 expires, and the like.

Figure 2:
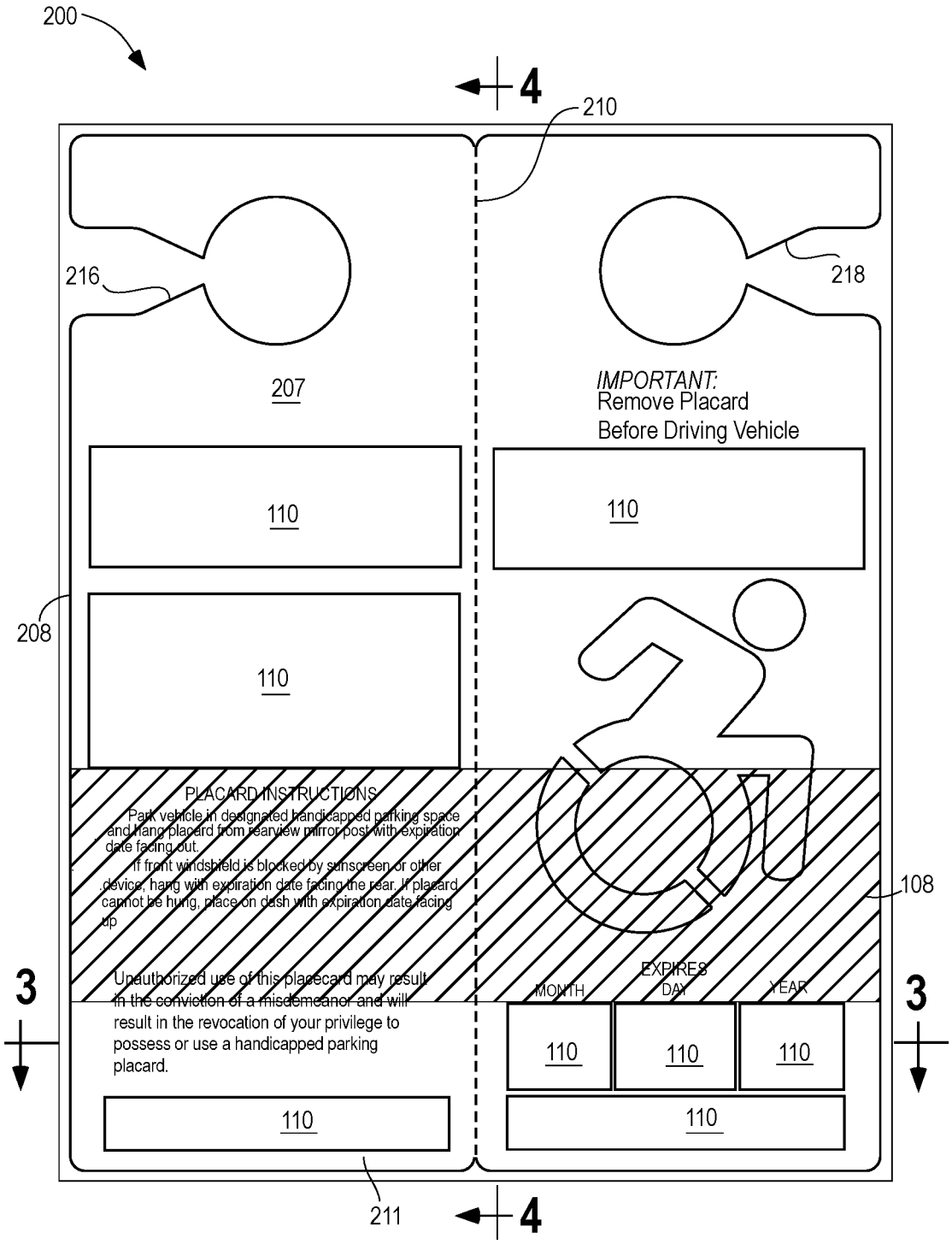
FIG. 2 is an elevational view of top side of a printable substrate from which the secure placard shown in FIG. 1A
Figure 3:
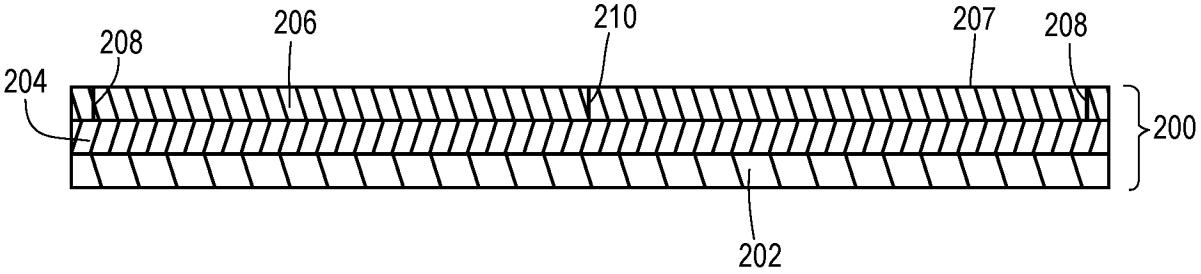
FIG. 3 is a sectional view of the printable substrate of FIG. 2 taken generally along the lines 3-3 of FIG. 2.
Figure 4:
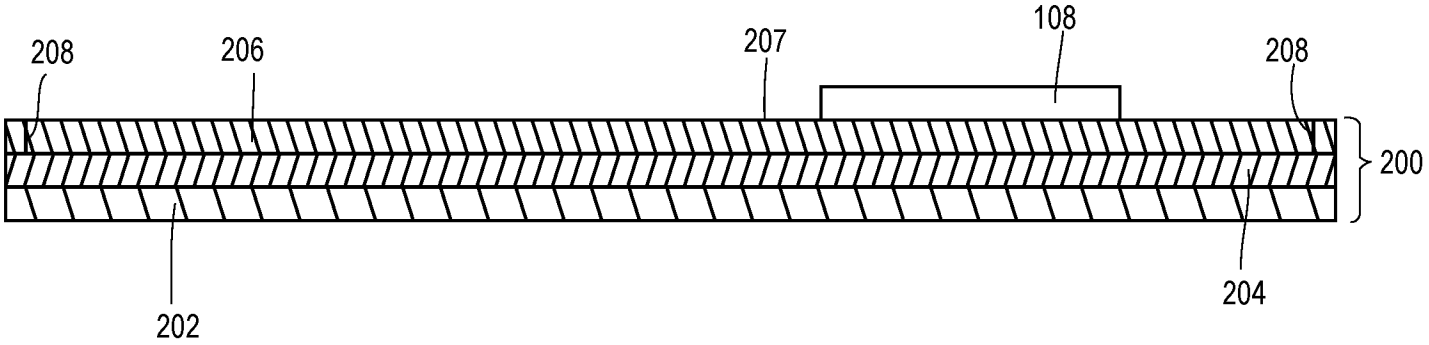
FIG. 4 is a sectional view of the printable substrate of FIG. 2 taken generally along the lines 4-4 of FIG. 2.

FIG. 2 shows a printable substrate 200 that may be provided to an issuing authority to have information imprinted in the regions 110 thereof and to form the secure placard 100. Referring to FIGS. 2-4, the printable substrate comprises a base substrate 202 and a releasable adhesive layer 204 applied on top of the base substrate. A printable layer 206 is removably secured to the base substrate 202 by the releasable adhesive layer 204.

In one embodiment, the base substrate 202 is a silicon-coated liner label and the printable layer 206 comprises a stiff laser printable material, including but not limited to a polyester film having a thickness of seven mils (i.e., 0.007 inches). The material for the releasable adhesive layer 204 is selected to adhere to the printable layer 206 when such layer is separated from the base substrate 202. In addition, the printable layer 206 may include a topcoat varnish that is toner receptive and applied to the printing surface thereof to enable laser (or other) printing thereon.

The holographic portion 108 is formed by using, for example, a Cast and Cure™ process developed by Breit Technologies of Overland Park, Kans. In such process, a relatively thin layer of a varnish material is selectively applied to a top surface 207 of the printable layer 206. The varnish material may be applied in a band across the printable substrate 200, or across the entire surface of the printable substrate 200, or may be applied in areas of the printable substrate 200 corresponding to one or mare various shapes, such as the geographic outline of a state or region, or one or more patterns that may represent a shape, logo, or combination of such. While still wet, a holographic film is applied to the thin layer of varnish to emboss a pattern therein. Thereafter, the holographic film is removed, and the thin layer of varnish is cured (e.g., using ultraviolet light or other type of radiation). After curing, the thin layer of varnish (and the holographic pattern formed therein) is sufficiently durable to withstand high temperatures that may be encountered during fusing of a xerographic or other printing process. In some embodiments, such fusing temperature may be, for example, between about 175 degrees and about 215 degrees Celsius (about 347 degrees and 419 degrees Fahrenheit). However, in other embodiments, such fusing temperature may be less than 175 degrees Celsius or greater than 215 degrees Celsius. Further, such varnish material is not susceptible to a build-up of static charge that may cause mis-feed problems when the printable substrate 200 is transported past rollers of the printing device, and is sufficiently thin to eliminate potential stacking issues as well as jamming issues that may occur as the printable substrate 200 passes through the printing device.

The printable substrate 200 includes a die cut 208 and a fold line 210. The die cut 208 and the fold line 210 may be formed in the printing substrate 200 either before the holographic portion 108 is applied thereto or after.

After the printable substrate 200 has been formed as described above, the printable substrate 200 may be imprinted by a printing device to add the information in the areas 110. Thereafter, a portion 211 of the printable layer 206 defined by the die cut 208 and the releasable adhesive layer 204 secured thereto are separated from the base substrate 202 and folded along the fold line 210 to form the secure placard 100. The adhesive layer 204 on the portion 211 facilitates securing the first side 102 and the second side 104, respectively, to one another to form the secure placard 100. After folding and securing in this manner, the die-cut 208 forms edges 212 of the secure placard 100 and the fold line forms the edge 214 of the secure placard 100. Further, a first segment 216 and a second segment 218 of the die cut 208 align with one another to form the cut-out portion 106.

Although the foregoing has been described as preparing a printable substrate 200 for use with a laser printing or xerographic printing process, it should be apparent the durability and static resistance may make printable substrate 200 suitable for any type of printing process including inkjet, lithography, intaglio, flexography, and the like to imprint information in the areas 110, especially those that are heat-based in which heat is applied during the imprinting process, for example, to melt, affix, fuse, cure or dry a material deposited on the substrate. Such printing substrate 200 may also be handwritten upon to imprint information in the areas 110.

Although the holographic portion 108 is shown in FIGS. 1-4 as being substantially rectangular, it should be apparent that such holographic portion 108 may be non-rectangular. In one embodiment, the holographic portion 108 is formed as a string of characters that represent, for example, an expiration date.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. It should be understood that the illustrated embodiments are exemplary only and should not be taken as limiting the scope of the disclosure.

I claim:

1. A secure placard, comprising:

a printable layer comprising a first portion and a second portion; and a radiation cured layer of varnish disposed on the first portion of the printable layer, wherein the layer of varnish has a holographic pattern formed therein prior to curing;

wherein the second portion of the printable layer is free of the varnish and the printable layer having the layer of varnish with the holographic pattern disposed thereon is transportable through a printing device to receive printing on the second portion using a heat-based process without damage to the holographic pattern.

2. The secure placard of claim 1, further including a topcoat varnish applied to at least the second portion of the printable layer, wherein the topcoat varnish is toner receptive.

3. The secure placard of claim 1, further including a substrate, wherein the printable layer is removably secured to the substrate by an adhesive.

4. The secure placard of claim 1, wherein the printable layer comprises a laser printable material.

5. The secure placard of claim 4, wherein the printable layer comprises a polyester film having a thickness of approximately 0.007 inches.

6. The secure placard of claim 4, wherein the second portion is printed on using the heat-based process, the printable layer includes a fold line, and the printable layer is folded along the fold line.

7. The secure placard of claim 1, further including a cut out portion that facilitates hanging the secure placard from a rear-view mirror of a vehicle.

8. The secure placard of claim 1, wherein the heat-based printing process includes xerography.

9. The secure placard of claim 1, wherein the layer of varnish is sufficiently durable to withstand a temperature of at least about 175° Celsius without damage to the holographic pattern.

10. A method of producing a secure placard comprising a printable layer having a first portion and a second portion, comprising the steps of:

applying varnish onto the first portion of the printable layer;

forming a holographic pattern in the varnish in the first portion;

curing the varnish layer in the first portion using radiation;

wherein the printable layer is adapted to be transportable through a printing device to receive printing on the second portion using a heat-based process after the varnish is applied on the first portion and without damaging the holographic pattern, wherein the second portion of the printable layer is free of the varnish.

11. The method of claim 10, further including the step of applying a topcoat varnish to at least the second portion of the printable layer, wherein the topcoat varnish is toner receptive.

12. The method of claim 10, further including the step of removably securing the printable layer to a substrate using an adhesive.

13. The method of claim 10, wherein the printable layer comprises a laser printable material.

14. The method of claim 13, wherein the printable layer comprises a polyester film having a thickness of approximately 0.007 inches.

15. The method of claim 10, further including the steps of printing on the second portion using the heat-based process and folding the substrate along a fold line after the second portion is printing upon.

16. The method of claim 10, further including the step of hanging the secure placard from a rear-view mirror of a vehicle.

17. The method of claim 10, wherein the step of using a heat-based process includes the step of using a xerographic process.

18. The method of claim 10, wherein the step of using the heat-based printing process includes exposing the layer of varnish to a temperature of at least 175° Celsius without damage to the holographic pattern.

* * * * *